US008807793B2

(12) United States Patent
Schroll et al.

(10) Patent No.: US 8,807,793 B2
(45) Date of Patent: Aug. 19, 2014

(54) DEVICE FOR SECURING A SOURCE OF LED LIGHT TO A HEAT SINK SURFACE

(75) Inventors: Matthew David Schroll, Glendale Heights, IL (US); Alan Emad Zantout, Sycamore, IL (US)

(73) Assignee: IDEAL, Industries, Inc., Sycamore, IL (US)

( * ) Notice: Subject to any disclaimer, the term of this patent is extended or adjusted under 35 U.S.C. 154(b) by 309 days.

(21) Appl. No.: 13/245,466

(22) Filed: Sep. 26, 2011

(65) Prior Publication Data

US 2013/0077324 A1 Mar. 28, 2013

(51) Int. Cl.
*F21V 21/088* (2006.01)

(52) U.S. Cl.
USPC ..... 362/249.02; 362/430; 362/457; 362/651

(58) Field of Classification Search
USPC ..... 362/218, 249.02, 288, 294, 429, 430, 362/457, 458, 549, 640, 649, 651
See application file for complete search history.

(56) References Cited

U.S. PATENT DOCUMENTS

| | | | | |
|---|---|---|---|---|
| 6,582,100 | B1 * | 6/2003 | Hochstein et al. | 362/294 |
| 7,405,944 | B2 * | 7/2008 | Mayer et al. | 362/294 |
| 7,988,336 | B1 * | 8/2011 | Harbers et al. | 362/549 |
| 2006/0141851 | A1 | 6/2006 | Matsui et al. | |
| 2006/0285349 | A1 * | 12/2006 | Helbig et al. | 362/549 |
| 2007/0268707 | A1 | 11/2007 | Smester | |
| 2011/0063849 | A1 | 3/2011 | Alexander et al. | |
| 2011/0164424 | A1 | 7/2011 | Breen, IV et al. | |

OTHER PUBLICATIONS

ISA/US, International Search Report and Written Opinion of PCT Application No. US12/57061, date of mailing of ISR/WO Dec. 4, 2012, 13 pages.

* cited by examiner

*Primary Examiner* — Y My Quach Lee
(74) *Attorney, Agent, or Firm* — Greenberg Traurig, LLP

(57) ABSTRACT

A device for securing a source of LED light to a heat sink includes a LED light source engaging surface that is arranged and configured to engage a least a portion of a the source of LED light and which is provided with an integrated force applying spring.

35 Claims, 6 Drawing Sheets

DEVICE FOR SECURING A SOURCE OF LED LIGHT TO A HEAT SINK SURFACE

BACKGROUND

Devices which utilized screw torque to secure a source of LED light, e.g., a LED light engine or a LED light module, to a surface of a heat sink are known in the art. Such known devices, however, suffer the disadvantage of failing to provide for an even engagement between the source of LED light and the surface of the heat sink, whether when initially used or over time due to degradation of material.

SUMMARY

Described hereinafter are improved devices for securing a source of LED light to a heat sink surface. More particularly, the subject devices include a LED light source engaging surface that is arranged to engage a least a portion of a source of LED light wherein a force applying spring is integrated into the LED light engaging surface. The integrated force applying spring functions to generally, uniformly push the source of LED light against the surface of the heat sink thereby eliminating the screw torque concerns of the prior art devices. By way of non-limiting example, the force applying spring can be integrated into the LED light engaging surface by providing the LED light engaging surface with one or more leaf-spring like mounting tabs and/or by providing the LED light engaging surface with a curved arrangement.

While the foregoing provides a general description of the subject devices for securing a source of LED light to a heat sink surface and some advantages thereof, a better understanding of the objects, advantages, features, properties, and relationships of the subject devices will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the hereinafter described devices for securing a source of LED light to a heat sink surface, reference may be had to the following drawings in which.

DETAILED DESCRIPTION

Turning now to the Figures, wherein like elements are referred to by like identifiers, illustrated are various embodiments of devices 10 that are usable to secure a source of LED light 12 to a surface of a heat sink 14. As will become apparent from the description that follows, the subject devices 10 have, among others, the advantage of providing for a more even engagement between the source of LED light 12 and the surface of the heat sink 14. More particularly, the subject devices 10 are arranged and constructed to provide upon the source of LED light 12 forces that are distributed over at least a substantial portion of the source of LED light 12 which forces function to drive the source of LED light 12 onto the surface of the heat sink 14 in a more even manner as compared to prior art devices. Furthermore, the subject device 10 are preferably constructed from a material, such as a metal, whereby the force applying characteristics of the devices 10 will not substantially degrade over time and usage.

Figure 2:
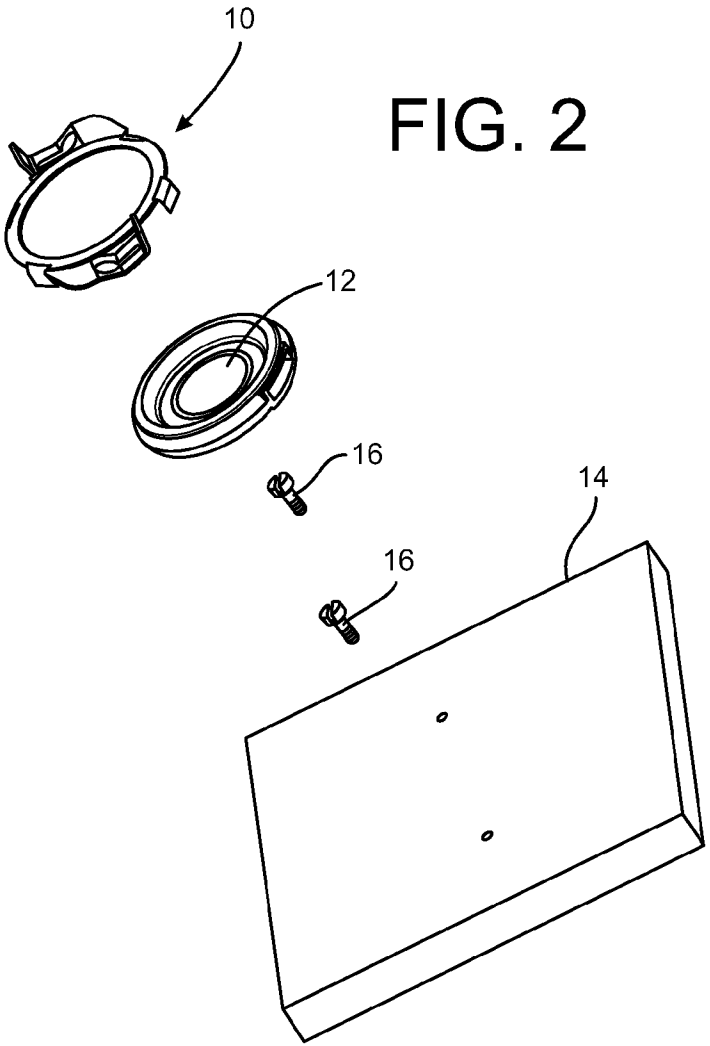
FIG. 2 illustrates an exploded view of the assembly of FIG. 1.
Figure 1:
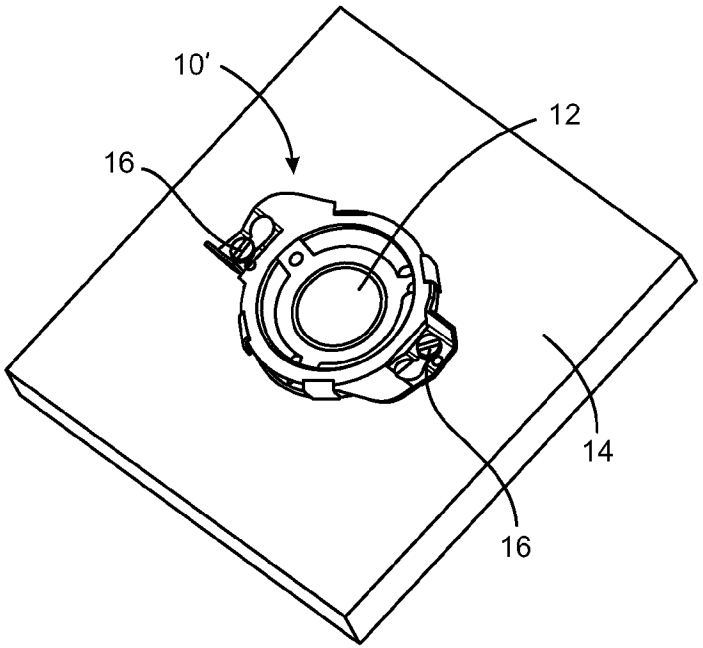
FIG. 1 illustrates an exemplary device being used to secure a source of LED light to a surface of a heat sink.
Figure 3:
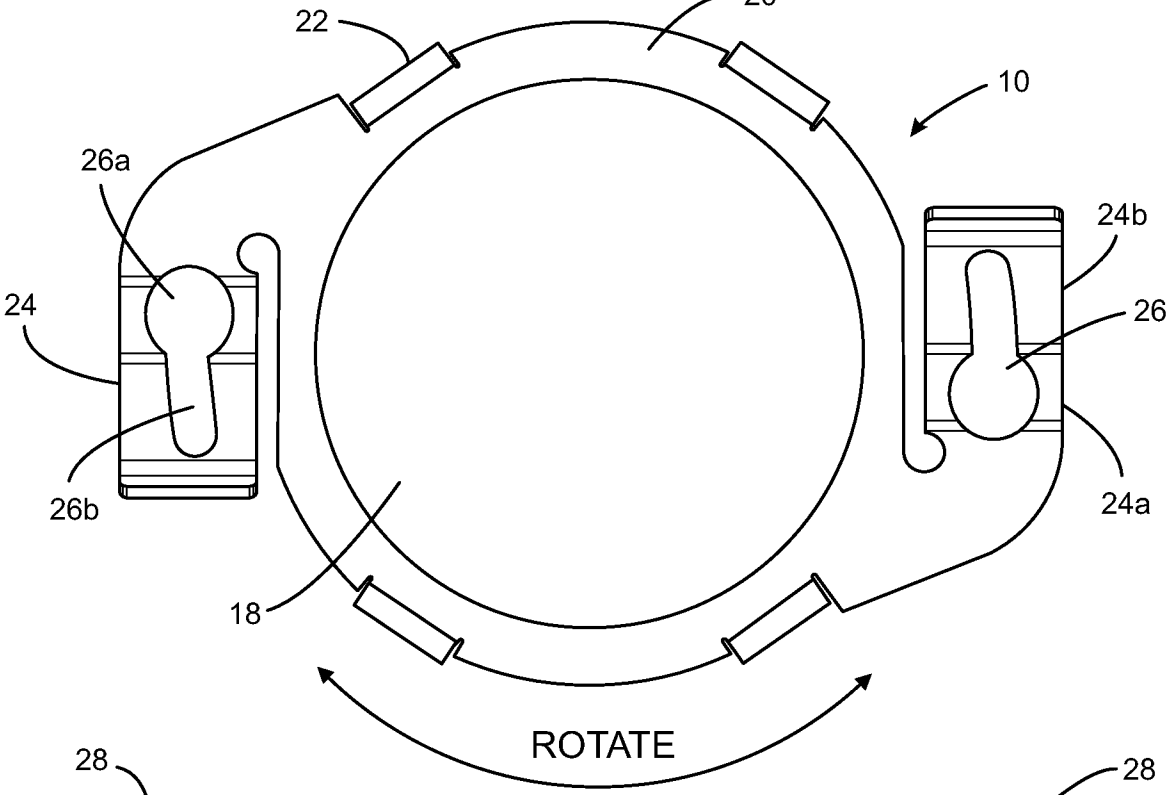
FIG. 3 is a top view of the exemplary device of FIG. 1.
Figure 4:
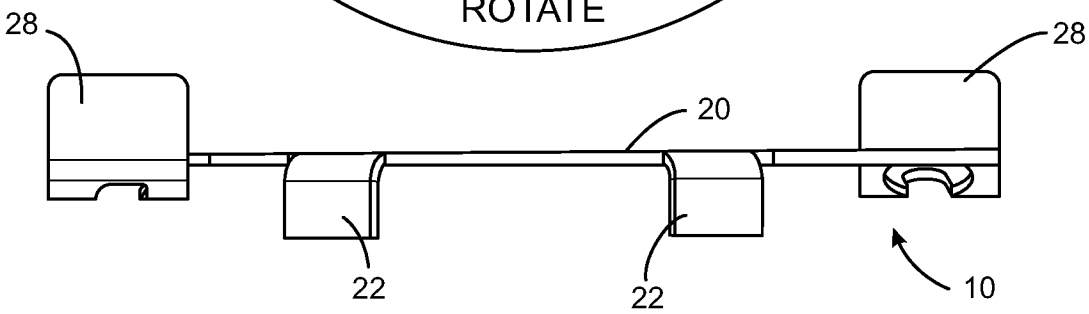
FIG. 4 is a side view of the exemplary device of FIG. 1.

Considering now FIGS. 1 and 2, FIG. 1 illustrates an exemplary device 10 being used to maintain a source of LED light 12, having a generally circular construction, to a surface of a heat sink 14. As shown in FIG. 1, the source of LED light 12 is disposed in between the device 10 and the surface of the heat sink 14 with the device 10 being secured to the surface of the heat sink 14 via use of fasteners 16. While the fasteners 16 are illustrated in the exemplary form of screws, it is to be appreciated that any form of fastener, particularly any form of fastener having an enlarged head portion, may be used for this purpose. In addition, the fasteners could be formed as a part of the heat sink, e.g., the fasteners and heat sink could be die cast as a one piece element.

For securing the source of LED light 12 to the surface of a heat sink 14, the device 10 is provided with an aperture 18 which is surrounded by an LED light source engaging surface 20. The LED light source engaging surface 20 is sized and arranged to engage at least a portion of the source of LED light 12. In the example shown in FIGS. 1-4, the LED light source engaging surface 20 is arranged to engage at least a portion of a top side of the source of LED light 12. For locating the source of LED light 12 under the LED light engaging surface 20, i.e., between the device 10 and the heat sink 14, the device 10 may optionally include one or more LED light source locating surfaces 22. When utilized, the LED light source locating surfaces 22 extend downwardly from the LED light source engaging surface 20, i.e., towards the heat sink 14, at positions whereby the LED light source locating surfaces 22 will be able to engage with corresponding side surfaces of the source of LED light 12. As will be appreciated, so as to not interfere with the desired engagement between the source of LED light 12 and the surface of the heat sink 14, the LED light source locating surfaces 22 will not extend downwardly from the LED light engaging surface 20 further than the bottom surface of the source of LED light 12.

For applying the desired forces upon the source of LED light 12 when the device 10 is secured to the heat sink surface 14 via use of the fasteners 16, the LED light engaging surface 20 includes an integrated force applying spring. In the exemplary embodiment of FIGS. 1-4, the integrated force applying spring is in the form of at least a pair of resilient or leaf-spring like mounting tabs 24 each having a key-shaped, fastener accepting opening 26. As shown in FIGS. 1-4, the mounting tabs 24 preferably extend from opposed sides of the LED light source engaging surface 20. As particularly illustrated in FIG. 2, the mounting tabs 24 are preferably provided with a first portion 24*a* that extends downwardly from the LED light source engaging surface 20 at a first angle and a second portion 26*b* that then extends upwardly from the end of the first portion 24*a* at a second angle where the key-shaped fastener accepting opening 26 spans the first portion 24*a* and the second portion 24*b*.

To secure the device 10 upon the heat sink surface 14 and thereby force the source of LED light 12 against the heat sink surface 14, the device 10 is first positioned such that the fastener 16 is received into a larger portion 26*a* of the key-shaped, fastener accepting opening 26 whereupon the device 10 is rotated to cause the fastener 16 to be moved into a narrower portion 26*b* of the key-shaped, fastener accepting opening 26. More particularly, as the device 10 is rotated, the head of the fastener 16 will be moved over a top surface of the second portion 24*a* of the mounting tab 24 and the resilient or leaf-spring like nature of the mounting tab 24, acting against the head of the fastener 16, will cause the LED light source engaging surface 20 of the device 10 to generally, uniformly push the source of LED light 12 against the surface of the heat sink 14. To assist in the rotating of the device 10, e.g., to lock and unlock the source of LED light 12 against the heat sink surface 14, one or more turn assisting surfaces 28 may also be provided to the device 10. By way of example only, the turn assisting surfaces 28 may be surfaces that are formed so as to extend upwardly from the ends of the mounting tabs 24. It will be further appreciated that the embodiment shown in FIGS. 1-4 also has the advantage of not requiring the fasteners 16 to be removed from the heat sink when it is desired to remove the source of LED light 12 there from.

Figure 10:
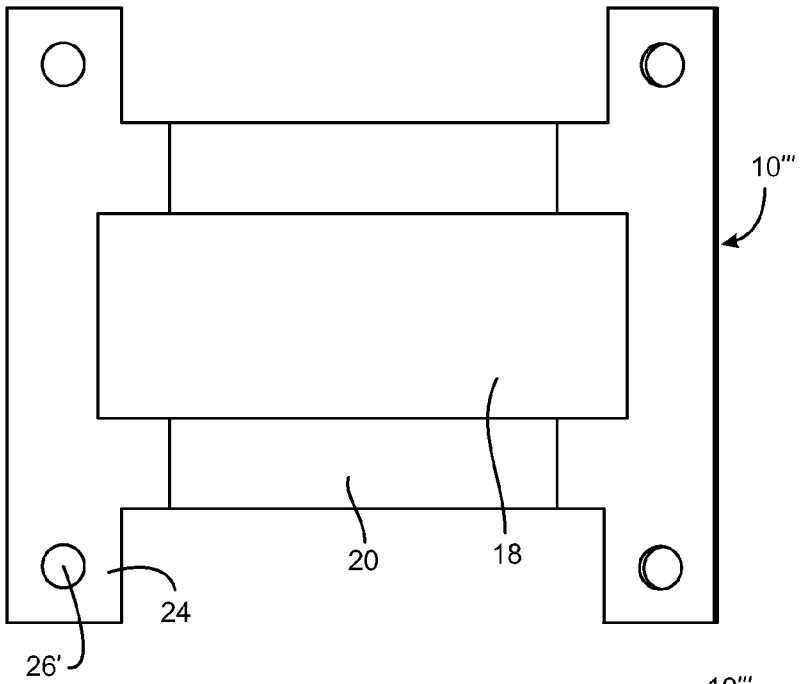
FIG. 10 is a top view of a yet further exemplary device for securing a source of LED light to a surface of a heat sink.

It is to be appreciated that the fastener accepting opening provided to the leaf-spring like mounting tabs 24 of the embodiment shown in FIGS. 1-4 may be in the form of otherwise conventional openings such as apertures 26' shown in FIG. 10 if so desired. In such a case, the openings 26' could be provided to any surface of the leaf-spring like mounting element that would allow the leaf spring to flex for the purpose above described.

Figure 5:
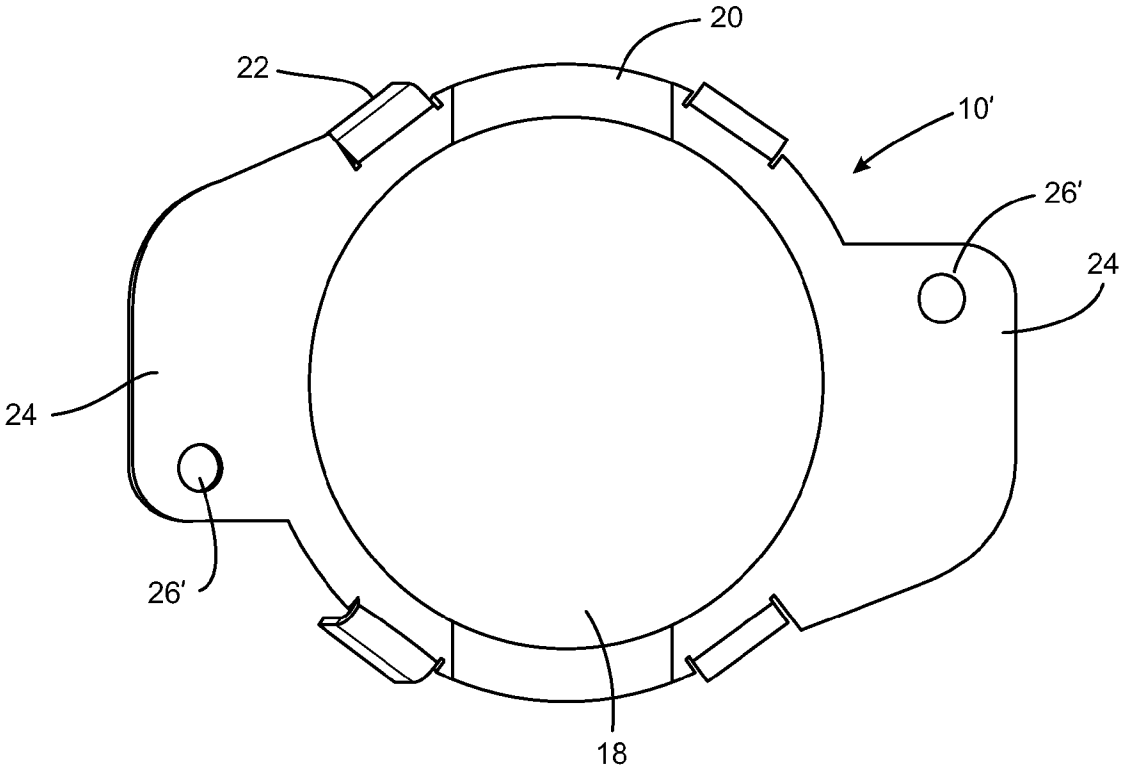
FIG. 5 is a top view of a further exemplary device for securing a source of LED light to a surface of a heat sink.
Figure 6:
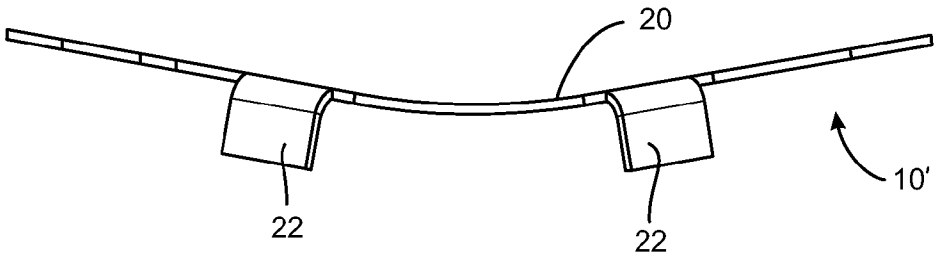
FIG. 6 is a side view of the exemplary device of FIG. 5.

Considering now FIGS. 5 and 6, a further device 10' is illustrated in which the LED light source engaging surface 20 of the embodiment shown in FIGS. 1-4 has been provided with an integrated spring by providing the LED light engaging surface 20 with an upwardly curved configuration when the device 10' is not under load. As particularly illustrated in FIG. 6, the LED light source engaging surface 20 is upwardly curved, i.e., curved away from the source of LED light 12/heat sink 14, from a center axis that is generally perpendicular to an axis formed between the mounting tabs 24. Because in such an arrangement the LED light source engaging surface 20 acts as a spring to apply the forces upon the source of LED light 12 when the device 10' is secured to the heat sink surface 14, in the embodiment shown in FIGS. 5 and 6, the mounting tabs 24 need not be provided with the bent, leaf-spring configuration that is utilized in connection with the embodiment shown in FIGS. 1-4. Such leaf-spring mounting tabs could, however, be utilized if desired. Furthermore, in the embodiment shown in FIGS. 5 and 6, fasteners 16 can be inserted into key-shaped openings as previously described or can be inserted into otherwise conventional fastener accepting opening 26'. In either case, the head of the fasteners 16 will be used to downwardly drive the device 10' with the LED light source engaging surface 20, owing to its integrated spring configuration, then functioning to apply a force upon the source of LED light 12 to generally, uniformly push the source of LED light 12 against the surface of the heat sink 14.

Figure 7:
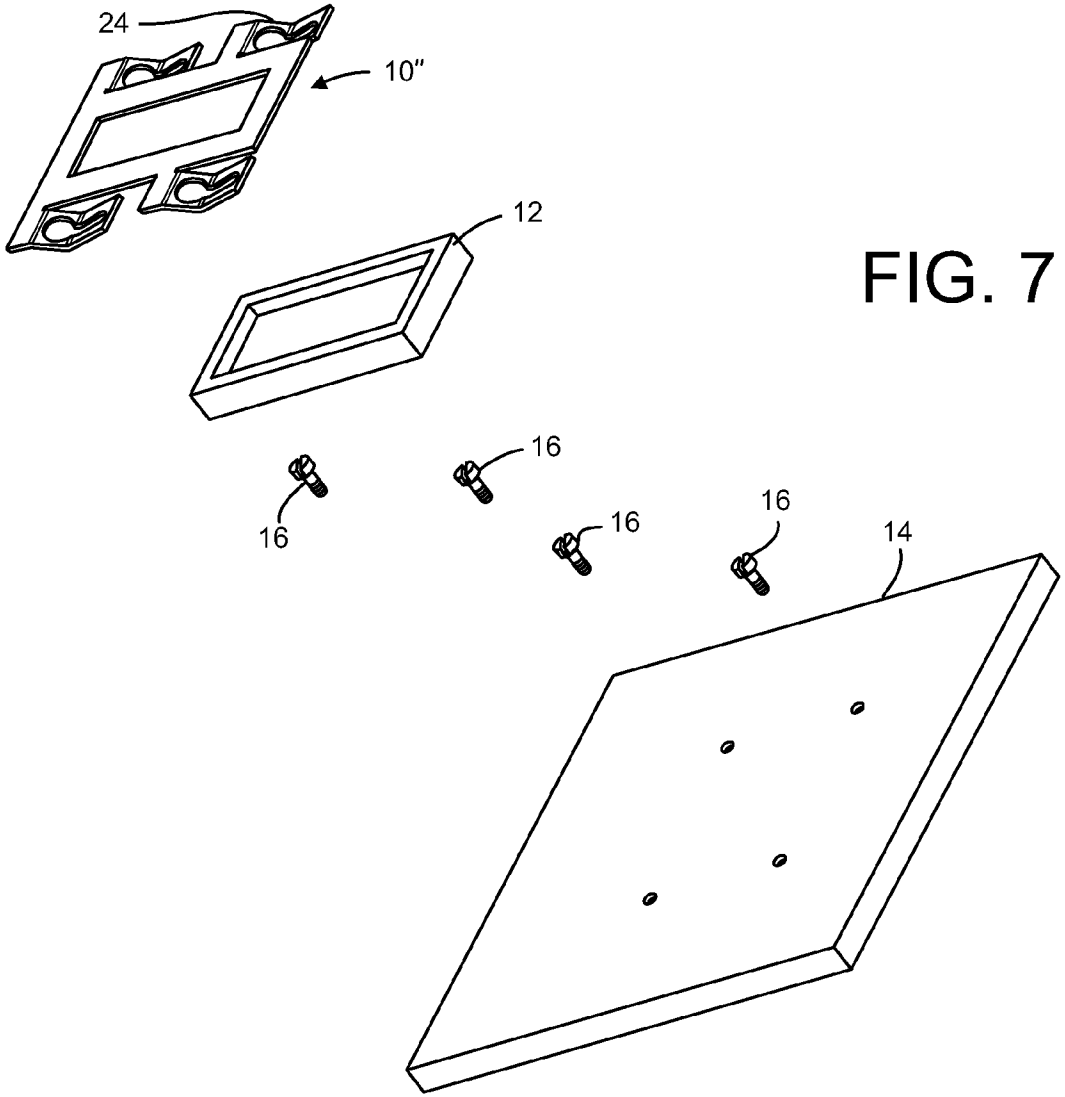
FIG. 7 illustrates an exploded view of a still further exemplary device being used to secure a source of LED light to a surface of a heat sink.
Figure 8:
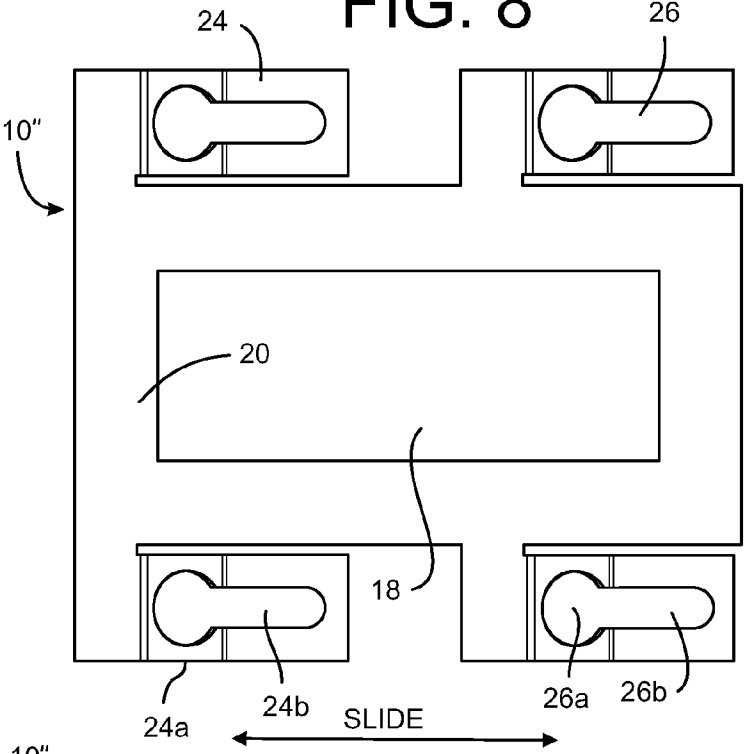
FIG. 8 is a top view of the exemplary device of FIG. 7.
Figure 9:
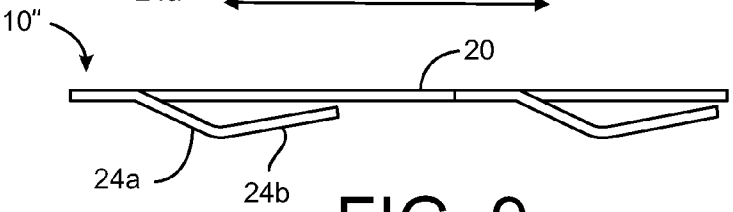
FIG. 9 is a side view of the exemplary device of FIG. 7.

Considering now FIGS. 7-9, a further device 10" is illustrated in which the generally planar LED light source engaging surface 20 of the embodiment shown in FIGS. 1-4 has been provided with a shape for engaging a source of LED light 12 having a generally rectangular configuration. As with the embodiment shown in FIGS. 1-4, the device 10" includes an integrated spring construction in the form of one or more leaf-spring like engagement tabs 24. The engagement tabs 24 are again arranged to cooperate with a head of a fastener 16 in the manner described above, i.e., to flex, to thereby cause the LED light source engaging surface 20 to apply a force upon the source of LED light 12 to generally, uniformly push the source of LED light 12 against the heat sink 14. Because of the rectangular configuration of the LED light source 12 in this assembly, rather than allow for the device 10" to be rotated into and out of engagement with the fasteners 16, the leaf-spring like engagement tabs 24 are arranged to allow the device 10" to be slid into and out of engagement with the fasteners 16.

Figure 11:
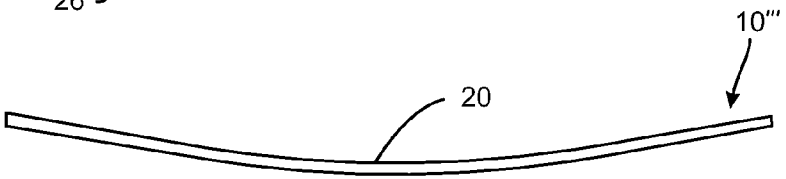
FIG. 11 is a side view of the exemplary device of FIG. 10.

Considering now FIGS. 10 and 11, a still further device 10''' is illustrated in which the LED light source engaging surface 20 of the embodiment shown in FIGS. 7-9 has been provided with an integrated spring by providing the LED light source engaging surface 20 with an upwardly curved configuration when the device 10''' is not under load. As particularly illustrated in FIG. 11, the LED light source engaging surface 20 is upwardly curved from a center axis that is generally intermediate the pairs of mounting tabs 24. As will be appreciated, in such an arrangement, the LED light source engaging surface 20 acts as a spring to apply the forces upon the source of LED light 12 when the device 10''' is secured to the heat sink surface 14. As before, in the embodiment shown in FIGS. 10 and 11, the mounting tabs 24 may optionally omit the bent, leaf-spring configuration that is utilized in connection with the embodiment shown in FIGS. 7-9. Similarly, the mounting tabs 24 may optionally omit the key-shaped openings 26 and may instead utilize otherwise conventional fastener accepting opening 26'. In either instance, the head of the fasteners 16 will be used to downwardly drive the device 10" with the LED light source engaging surface 20, owing to its integrated spring configuration, then functioning to apply a force upon the source of LED light 12 to generally, uniformly push the source of LED light 12 against the surface of the heat sink 14.

Figure 12:
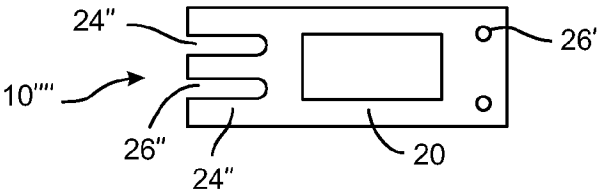
FIG. 12 is a top view of a still further exemplary device for securing a source of LED light to a surface of a heat sink.
Figure 13:
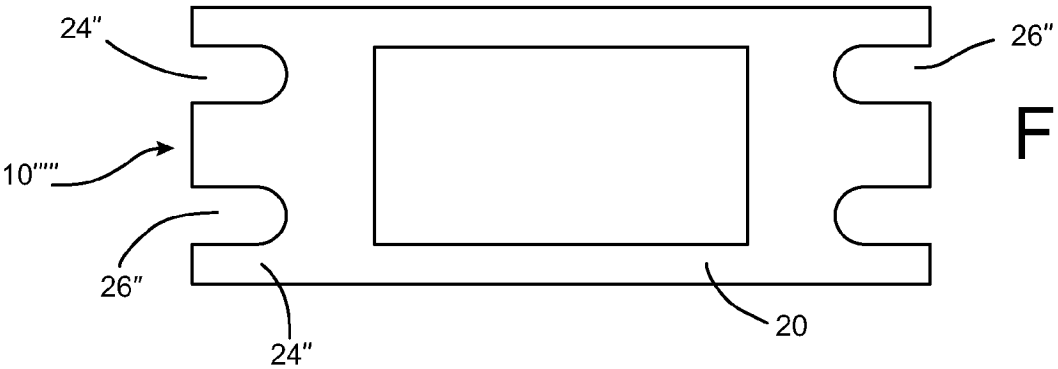
FIG. 13 is a top view of yet another exemplary device for securing a source of LED light to a surface of a heat sink.
Figure 14:
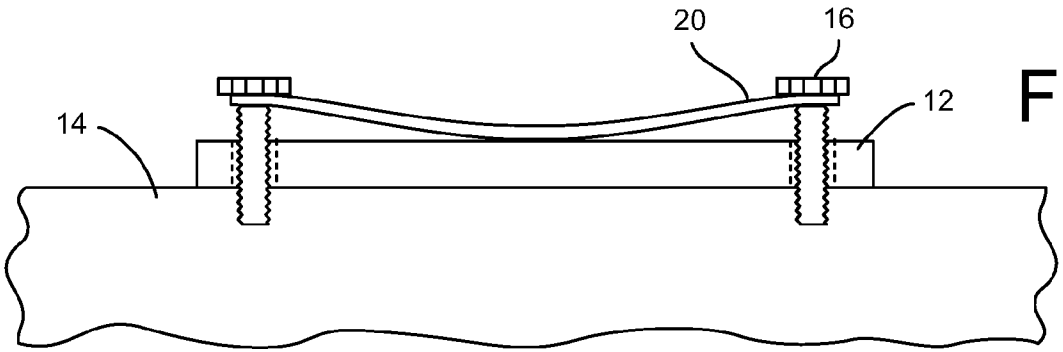
FIG. 14 is a side view of the exemplary device of FIG. 13.

In FIG. 13, a further device 10'''' is illustrated which provides slots 26" adjacent to mounting elements 24". In this manner, when a fastener 16 is received into the slots 26", e.g., by being slid therewithin, the integrated spring provided to the LED light engaging surface 20, e.g., as provided by the upwardly curved surface of the LED light engaging surface 20 as shown in FIG. 14, will function to generally, uniformly push the source of LED light 12 against the surface of the heat sink 14. While not shown, in such embodiments, the mounting elements could be provided with leaf-spring like or flexible elements in addition to or alternatively to providing the LED light engaging surface 20 with an integrated spring curve as noted above. In addition, as illustrated in FIG. 12, a still further device 10'''' may be provided with slots 26" for receiving fasteners 16 as well as apertures 26'. As will be understood, the use of such slots 26" may allow for the removal of the device and/or removal of the source of LED light from under the device without requiring removal of all of the fasteners 16 from the heat sink 14.

While specific embodiments of the subject invention have been described in detail, it will be appreciated by those skilled in the art that various modifications and alternatives to those details could be developed in light of the overall teachings of this disclosure. It will therefore be appreciated that features described with respect to the various embodiments are not to be limited to any particular embodiment but may be freely used across embodiments where applicable. Additionally, it will be appreciate that the size, shape, arrangement, and/or number of components illustrated and described can be changed as necessary to meet a given need. Accordingly, the particular arrangements disclosed are meant to be illustrative only and not limiting as to the scope of the invention which is to be given the full breadth of the appended claims and any equivalents thereof.

What is claimed is:

1. A device for securing a source of LED light to a surface of a heat sink, comprising:

a LED light source engaging surface arranged to engage a least a portion of the source of LED light;

a first mounting tab integrally formed with the LED light source engaging surface at a first end of the LED light source engaging surface; and a second mounting tab integrally formed with the LED light source engaging surface at a second end of the LED light source engaging surface;

wherein the second end of the LED light source engaging surface is opposed to the first end of the LED light engaging surface and wherein the LED light source engaging surface is curved upwardly towards the first and second ends of the LED light source engaging surface from a location that is intermediate the first and second ends of the LED light source engaging surface whereby the LED light source engaging surface will apply a force upon the source of LED light to generally, uniformly push the source of LED light against the surface of the heat sink when the first and second mounting tabs are used to secure the source of LED light to the heat sink.

2. The device as recited in claim 1, wherein the LED light source engaging surface is adapted to engage a source of LED light having a generally rectangular shape.

3. The device as recited in claim 1, wherein the LED light source engaging surface is adapted to engage a source of LED light having a generally circular shape.

4. The device as recited in claim 1, wherein the LED light source engaging surface and the first and second mounting tabs are formed using a metallic material.

5. The device as recited in claim 1, wherein the first and second mounting tabs are each formed as leaf-spring like structure.

6. The device as recited in claim 5, wherein the leaf-spring like structure includes a first surface which extends downwardly from the LED light source engaging surface at a first angle and a second surface which extends upwardly from an end of the first surface at a second angle.

7. The device as recited in claim 6, comprising a fastener accepting opening having a key-shape which extends between the first surface and the second surface of the leaf-spring like structure.

8. The device as recited in claim 7, wherein the LED light source engaging surface is adapted to engage a source of LED light having a generally rectangular shape and wherein the device is secured to the heat sink by sliding the device to cause a fastener to be moved within the opening having the key-shape such that the fastener engages with a top surface of the second surface of the leaf-spring structure.

9. The device as recited in claim 7, wherein the LED light source engaging surface is adapted to engage a source of LED light having a generally circular shape and wherein the device is secured to the heat sink by rotating the device to cause a fastener to be moved within the opening having the key-shape such that the fastener engages with a top surface of the second surface of the leaf-spring structure.

10. The device as recited in claim 1, wherein the LED light source engaging surface comprises one or more integrally formed, downwardly extended surfaces which are arranged to engage a corresponding side of the source of LED light to thereby locate the source of LED light under the LED light source engaging surface.

11. The device as recited in claim 2, wherein the LED light source engaging surface comprises one or more integrally formed, downwardly extended surfaces which are arranged to engage a corresponding side of the source of LED light to thereby locate the source of LED light under the LED light source engaging surface.

12. The device as recited in claim 3, wherein the LED light source engaging surface comprises one or more integrally formed, downwardly extended surfaces which are arranged to engage a corresponding side of the source of LED light to thereby locate the source of LED light under the LED light source engaging surface.

13. The device as recited in claim 8, wherein the LED light source engaging surface comprises one or more integrally formed, downwardly extended surfaces which are arranged to engage a corresponding side of the source of LED light to thereby locate the source of LED light under the LED light source engaging surface.

14. The device as recited in claim 9, wherein the LED light source engaging surface comprises one or more integrally formed, downwardly extended surfaces which are arranged to engage a corresponding side of the source of LED light to thereby locate the source of LED light under the LED light source engaging surface.

15. A device for securing a source of LED light to a surface of a heat sink, comprising:

a LED light source engaging surface arranged to engage a least a portion of the source of LED light; and one or more mounting tabs integrally formed with the LED light source engaging surface;

wherein the LED light source engaging surface is provided with an integral force applying structure which applies a force upon the source of LED light to generally, uniformly push the source of LED light against the surface of the heat sink when the mounting tabs are used to secure the source of LED light to the heat sink, wherein the one or more mounting tabs are formed as a leaf-spring like structure to thereby provide the integral force applying structure, and wherein the leaf-spring like structure has a fastener accepting opening having a key-shape which extends between a first surface and a second surface of the leaf-spring like structure.

16. The device as recited in claim 15, wherein the LED light source engaging surface is adapted to engage a source of LED light having a generally rectangular shape and wherein the device is secured to the heat sink by sliding the device to cause a fastener to be moved within the opening having the key-shape such that the fastener engages with a top surface of the second surface of the leaf-spring structure.

17. The device as recited in claim 15, wherein the LED light source engaging surface is adapted to engage a source of LED light having a generally circular shape and wherein the device is secured to the heat sink by rotating the device to cause a fastener to be moved within the opening having the key-shape such that the fastener engages with a top surface of the second surface of the leaf-spring structure.

18. The device as recited in claim 15, wherein the LED light source engaging surface comprises one or more integrally formed, downwardly extended surfaces which are arranged to engage a corresponding side of the source of LED light to thereby locate the source of LED light under the LED light source engaging surface.

19. The device as recited in claim 16, wherein the LED light source engaging surface comprises one or more integrally formed, downwardly extended surfaces which are arranged to engage a corresponding side of the source of LED light to thereby locate the source of LED light under the LED light source engaging surface.

20. The device as recited in claim 17, wherein the LED light source engaging surface comprises one or more integrally formed, downwardly extended surfaces which are arranged to engage a corresponding side of the source of LED light to thereby locate the source of LED light under the LED light source engaging surface.

21. A device for securing a source of LED light to a surface of a heat sink, comprising:

a LED light source engaging surface arranged to engage a least a portion of the source of LED light; and a plurality of mounting tabs integrally formed with the LED light source engaging surface and a plurality of slots disposed between respective pairs of the plurality of mounting tabs;

wherein the LED light source engaging surface is curved upwardly and is provided with an integral force applying structure which applies a force upon the source of LED light to generally, uniformly push the source of LED light against the surface of the heat sink when the mounting tabs are used to secure the source of LED light to the heat sink with fasteners disposed in the plurality of slots.

22. The device as recited in claim 21, wherein the LED light source engaging surface is adapted to engage a source of LED light having a generally rectangular shape.

23. The device as recited in claim 21, wherein the LED light source engaging surface is adapted to engage a source of LED light having a generally circular shape.

24. The device as recited in claim 21, wherein the LED light source engaging surface and the plurality of mounting tabs are formed using a metallic material.

25. The device as recited in claim 21, wherein the LED light source engaging surface is adapted to engage a source of LED light having a generally rectangular shape and wherein the device is secured to the heat sink by sliding the device to cause fasteners to be moved within the slots.

26. The device as recited in claim 21, wherein the LED light source engaging surface is adapted to engage a source of LED light having a generally circular shape and wherein the device is secured to the heat sink by rotating the device to cause fasteners to be moved within the slots.

27. The device as recited in claim 21, wherein the LED light source engaging surface comprises one or more integrally formed, downwardly extended surfaces which are arranged to engage a corresponding side of the source of LED light to thereby locate the source of LED light under the LED light source engaging surface.

28. A device for securing a source of LED light to a surface of a heat sink, comprising:

a LED light source engaging surface arranged to engage a least a portion of the source of LED light; and a plurality of mounting tabs integrally formed with the LED light source engaging surface, each of the plurality of mounting tabs comprising a v-shaped leaf-spring like structure wherein the v-shaped leaf spring like structure has a first surface which extends downwardly from an outside edge of the LED light source engaging surface at a first angle and a second surface which extends upwardly from an end of the first surface that is opposite from the outside edge of the LED light source engaging surface at a second angle;

wherein the LED light source engaging surface and the plurality of mounting tabs cooperate to apply a force upon the source of LED light to generally, uniformly push the source of LED light against the surface of the heat sink when the mounting tabs are used to secure the source of LED light to the heat sink.

29. The device as recited in claim 28, comprising a fastener accepting opening having a key-shape which extends between the first surface and the second surface of the leaf-spring like structure.

30. The device as recited in claim 29, wherein the LED light source engaging surface is adapted to engage a source of LED light having a generally rectangular shape and wherein the device is secured to the heat sink by sliding the device to cause a fastener to be moved within the opening having the key-shape such that the fastener engages with a top surface of the second surface of the leaf-spring structure.

31. The device as recited in claim 29, wherein the LED light source engaging surface is adapted to engage a source of LED light having a generally circular shape and wherein the device is secured to the heat sink by rotating the device to cause a fastener to be moved within the opening having the key-shape such that the fastener engages with a top surface of the second surface of the leaf-spring structure.

32. The device as recited in claim 28, wherein the LED light source engaging surface comprises one or more integrally formed, downwardly extended surfaces which are arranged to engage a corresponding side of the source of LED light to thereby locate the source of LED light under the LED light source engaging surface.

33. The device as recited in claim 29, wherein the LED light source engaging surface comprises one or more integrally formed, downwardly extended surfaces which are arranged to engage a corresponding side of the source of LED light to thereby locate the source of LED light under the LED light source engaging surface.

34. The device as recited in claim 30, wherein the LED light source engaging surface comprises one or more integrally formed, downwardly extended surfaces which are arranged to engage a corresponding side of the source of LED light to thereby locate the source of LED light under the LED light source engaging surface.

35. The device as recited in claim 31, wherein the LED light source engaging surface comprises one or more integrally formed, downwardly extended surfaces which are arranged to engage a corresponding side of the source of LED light to thereby locate the source of LED light under the LED light source engaging surface.

* * * * *